US010823435B2

(12) United States Patent
Jin et al.

(10) Patent No.: US 10,823,435 B2
(45) Date of Patent: Nov. 3, 2020

(54) AIR CONDITIONER

(71) Applicant: KYUNGDONG NAVIEN CO., LTD., Pyeongtaek-si (KR)

(72) Inventors: Won Jae Jin, Anyang-si (KR); Jae Hyun Han, Anyang-si (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 90 days.

(21) Appl. No.: 16/042,694

(22) Filed: Jul. 23, 2018

(65) Prior Publication Data

US 2019/0063761 A1 Feb. 28, 2019

(30) Foreign Application Priority Data

Aug. 31, 2017 (KR) ..... 10-2017-0111081

(51) Int. Cl.

| | |
|---|---|
| ***F24F 3/14*** | (2006.01) |
| ***F24F 5/00*** | (2006.01) |
| ***F24F 11/30*** | (2018.01) |
| ***F24F 13/10*** | (2006.01) |
| ***F24F 11/00*** | (2018.01) |

(Continued)

(52) U.S. Cl.

CPC ..... *F24F 3/14* (2013.01); *F24F 3/1411* (2013.01); *F24F 3/1423* (2013.01); *F24F 5/0035* (2013.01); *F24F 11/0008* (2013.01); *F24F 11/30* (2018.01); *F24F 13/10* (2013.01); *F24F 2003/1458* (2013.01); *F24F 2203/1024* (2013.01)

(58) Field of Classification Search

CPC ..... F24F 3/14; F24F 3/1423; F24F 3/1411; F24F 5/0035; F24F 11/0008; F24F 2003/1458; F24F 2203/1024

USPC ..... 62/272

See application file for complete search history.

(56) References Cited

U.S. PATENT DOCUMENTS

| | | | | |
|---|---|---|---|---|
| 4,910,971 | A | 3/1990 | McNab | 62/310 |
| 6,099,623 | A | 8/2000 | Namatame et al. | 96/125 |
| 2004/0134211 | A1* | 7/2004 | Lee | F24F 12/003 62/271 |

FOREIGN PATENT DOCUMENTS

| | | | |
|---|---|---|---|
| CN | 104534604 | A | 4/2015 |
| CN | 106907808 | A | 6/2017 |

(Continued)

*Primary Examiner* — Steve S Tanenbaum

(74) *Attorney, Agent, or Firm* — Stein IP, LLC

(57) ABSTRACT

The present disclosure is directed to provide an air conditioner using an evaporative cooler to cool a condenser and improve cooling efficiency, and configured to supply air, which passes through a dry channel of the evaporative cooler, to a humid channel to improve efficiency of the evaporative cooler. In order to implement above, the air conditioner according to the present disclosure includes an indoor unit including an evaporator of a heat pump configured to cool indoor air; and an outdoor unit including the evaporative cooler using evaporation latent heat of water generated from the humid channel to cool air which passes through the dry channel, a condenser of the heat pump cooled by air cooled while passing through the dry channel during a cooling mode, a condenser communication part provided so that some of the air which passes through the dry channel flows to the condenser, and a humid channel communication part provided so that the remaining air which passes through the dry channel flows to the humid channel.

8 Claims, 2 Drawing Sheets

(51) Int. Cl.
*F24F 11/65* (2018.01)
*F24F 13/30* (2006.01)

(56) References Cited

FOREIGN PATENT DOCUMENTS

KR 10-1071350 B1 10/2011
KR 10-2016-0088846 A 7/2016

* cited by examiner

[FIG. 1]
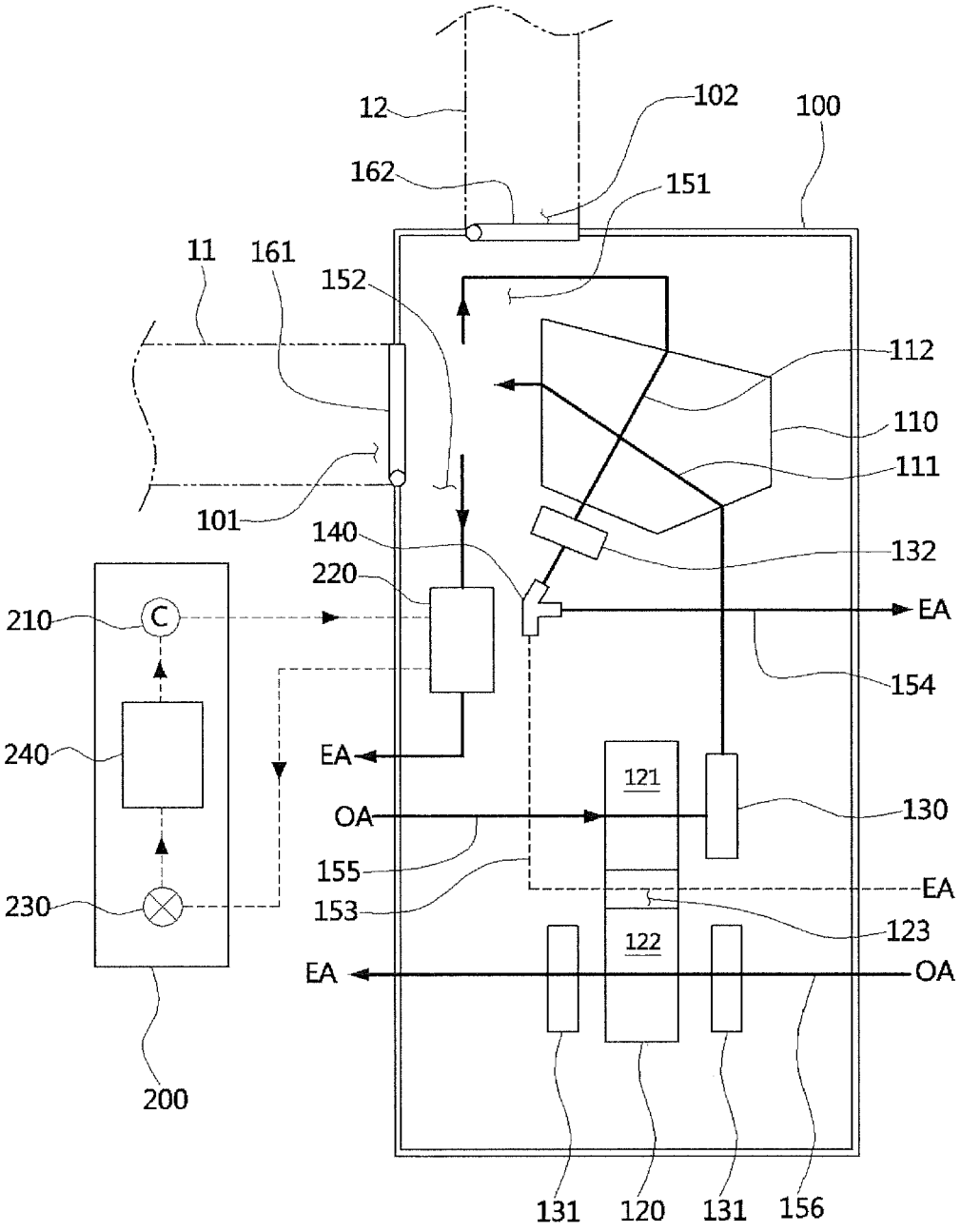

[FIG. 2]
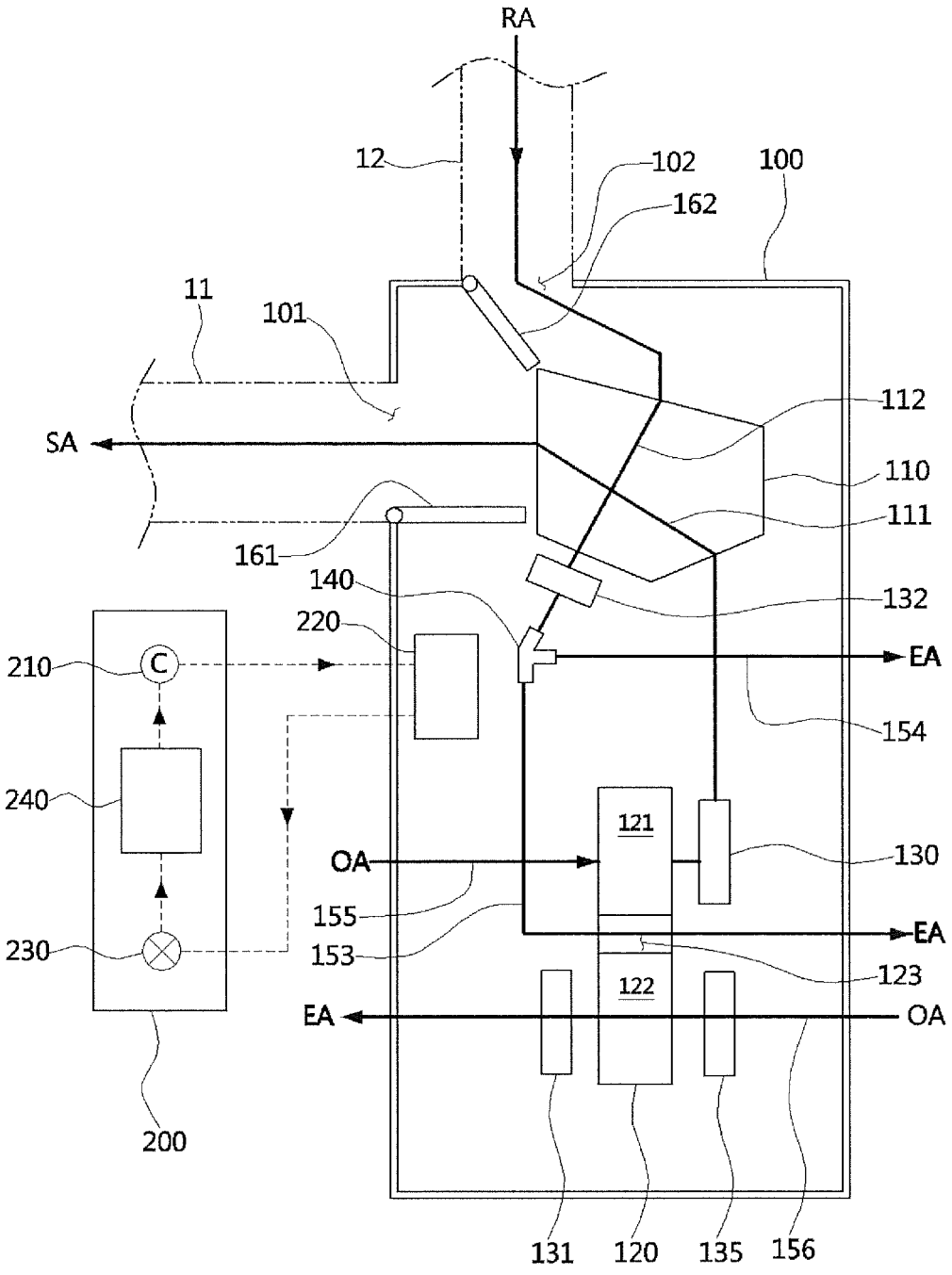

AIR CONDITIONER

CROSS-REFERENCE TO RELATED APPLICATION

This application claims priority to and the benefit of Korean Patent Application No. 10-2017-0111081, filed on Aug. 31, 2017, the disclosure of which is incorporated herein by reference in its entirety.

BACKGROUND

1. Field of the Invention

The present disclosure relates to an air conditioner, and more specifically, to an air conditioner configured to cool a condenser using an evaporative cooler.

2. Discussion of Related Art

Generally, an air conditioner is an apparatus configured to maintain a pleasant indoor space by adjusting an indoor temperature and humidity or circulating indoor air according to a demand of a user.

Recently, technology capable of maintaining pleasant indoor air depending on seasonal change according to a choice of a user has been developed by adding various functions such as dehumidification, humidification, air purification, ventilation, and the like to an air conditioner.

A dehumidification cooling system is disclosed in Korean Laid-Open Patent No. 10-2016-0088846 as a conventional technology related to the air conditioner.

In the conventional technology, an evaporated water injector is provided to be capable of injecting water to a condenser, and the water injected on a surface of the condenser is evaporated by low temperature and humidity air which passes through a dehumidification rotor and a cooler which is capable of increasing efficiency of a vapor compression cooler by cooling the condenser. Further, an introduction port for ventilation and an air supply port for ventilation are provided to perform ventilation.

However, in a case of the conventional technology, since the evaporated water injector configured to inject the water to the condenser is provided to cool the condenser, a configuration of an apparatus becomes complicated. Further, when an evaporative cooler is used as a cooler, since an additional evaporated water injector should be provided and air cooled in the evaporative cooler cannot be reused, cooling efficiency is lessened.

SUMMARY OF THE INVENTION

The present disclosure is directed to providing an air conditioner capable of improving cooling efficiency by cooling a condenser using an evaporative cooler, and improving durability of a heat pump by preventing repetitive on/off operations of a compressor due to overheating of the condenser.

Further, the present disclosure is directed to providing an air conditioner configured to supply air, which passes through a dry channel of the evaporative cooler, to a humid channel to improve efficiency of the evaporative cooler.

In addition, the present disclosure is directed to providing an air conditioner capable of simplifying a pipe structure by using the dry channel and the humid channel of the evaporative cooler as a path through which indoor air and outdoor air move during a ventilation mode.

In addition, the present disclosure is directed to providing an air conditioner configured to allow total heat exchange between the air emitted to an outdoor space from an indoor space, and the air introduced into the indoor space from the outdoor space during the ventilation mode to occur to improve heat efficiency.

According to an aspect of the present disclosure, there is provided an air conditioner including: an indoor unit including an evaporator of a heat pump configured to cool indoor air; and an outdoor unit including an evaporative cooler using evaporation latent heat of water generated from a humid channel to cool air which passes through a dry channel, a condenser of the heat pump cooled by air cooled while passing through the dry channel during a cooling mode, a condenser communication part provided so that some of the air which passes through the dry channel flows to the condenser, and a humid channel communication part provided so that the remaining air which passes through the dry channel flows to the humid channel.

The outdoor unit may include a first opening configured to communicate with an indoor air introduction path configured to supply air to an indoor space, a first damper configured to open or close the first opening and the condenser communication part, a second opening configured to communicate with an indoor air discharge path configured to suction the air from the indoor space, and a second damper configured to open or close the second opening and the humid channel communication part.

When indoor air is cooled in the evaporator of the indoor unit, the first damper may close the first opening so that some of the air which passes through the dry channel may pass through the condenser to cool the condenser, and the second damper may close the second opening so that the remaining air which passes through the dry channel may flow to the humid channel.

During a ventilation mode, the first damper may block the condenser communication part with opening the first opening, and air introduced from an outdoor space may be supplied to the indoor space through the first opening after passing through the dry channel, and the second damper may block the humid channel communication part with opening the second opening, and the indoor air may be discharged to the outside after passing through the second opening and the humid channel.

The outdoor unit may include a dehumidification rotor formed from a first area provided on an outdoor air supply path connected to the dry channel and through which the air introduced from the outdoor space passes, a second area provided on a regeneration path configured to communicate with the outdoor space, and a third area provided on a first discharge path provided between the first area and the second area and through which the air which passes through the humid channel is discharged to the outdoor space.

A second discharge path through which the air which passes through the humid channel is discharged to the outdoor space may be provided, and a path changer may be provided so that the air which passes through the humid channel flows through one of the first discharge path and the second discharge path.

A path may be connected so that the air suctioned from the outdoor space may be supplied to an indoor space after passing through the dry channel, and a path may be connected so that the air discharged from the indoor space may pass through the third area through the first discharge path after passing through the humid channel.

During a ventilation mode, the dehumidification rotor may rotate, and total heat exchange may occur between the air which passes through each of the first area and the third area of the dehumidification rotor.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which:

FIG. 1 is a view illustrating a configuration of an air conditioner according to the present disclosure; and FIG. 2 is a view illustrating a state in which a damper is rotated in the air conditioner in FIG. 1.

DETAILED DESCRIPTION OF EXEMPLARY EMBODIMENTS

Hereinafter, an air conditioner according to the present disclosure will be described in detail with reference to the accompanying drawings.

A configuration of the air conditioner according to the present disclosure will be described with reference to FIG. 1.

An air conditioner 1 according to the present disclosure includes an outdoor unit 100 and an indoor unit 200.

The indoor unit 200 may be installed as a stand type in an indoor space, in which a user lives, or may be installed on a ceiling as a ceiling type. The outdoor unit 100 is installed in an air conditioner outdoor unit room, a boiler room, etc.

Each of the outdoor unit 100 and the indoor unit 200 includes a heat pump to cool indoor air using a refrigerant. The heat pump is formed from a compressor 210 configured to compress the refrigerant at high temperature and high pressure, a condenser 220 configured to radiate heat of the refrigerant compressed in the compressor 210 at the high temperature and high pressure, an expansion valve 230 in which the refrigerant which passes through the condenser 220 is expanded to have a low temperature and a low pressure, and an evaporator 240 configured to absorb heat of the indoor air while the refrigerant which passes through the expansion valve 230 is evaporated. In this case, the condenser 220 may be provided in the outdoor unit 100, and the compressor 210, the expansion valve 230, and the evaporator 240 may be provided in the indoor unit 200.

The outdoor unit 100 includes an evaporative cooler 110, a dehumidification rotor 120, blowers 130, 131, and 132, the condenser 220, a flow path changer 140, a first damper 161, and a second damper 162.

The evaporative cooler 110 is formed from a dry channel 111 and a humid channel 112 each having the separated insides, and is provided so that heat exchange between air which flows through the dry channel 111 and air which flows through the humid channel 112 occurs. The humid channel 112 includes a water injection device (not shown) configured to supply water, and latent heat generated when the water supplied from the water injection device is evaporated by the air which flows through the humid channel 112 is used to cool the air which flows through the dry channel 111.

An air flow in a downward direction is formed in the humid channel 112 so that the water may flow due to the water injection device, and an air flow in an upward direction is formed in the dry channel 111.

In the air which passes through the dry channel 111, during cooling, some of the air (70% of the air) flows to the condenser 220, and the remaining air (30% of the air) flows to the humid channel 112 through a humid channel communication part 151. The air which passes through the humid channel 112 flows to the flow path changer 140. In a case in which the condenser 220 is cooled using the air cooled in the dry channel 111, cooling performance may be further improved as compared to a case in which the condenser 220 is cooled using air at room temperature.

The dehumidification rotor 120 is formed from a first area 121 configured to adsorb moisture from air which passes through an outdoor air supply path 155, a second area 122 configured to remove the humidity adsorbed on the first area 121 to regenerate the dehumidification rotor 120 using air which passes through a regeneration path 156, and a third area 123 provided between the first area 121 and the second area 122 to adsorb moisture from the air having greater moisture by passing through the humid channel.

The dehumidification rotor 120 is rotated by a driving part (not shown) on the basis of a shaft provided at a center to repeat a moisture adsorption process and a regeneration process. An adsorption material for adsorbing humidity may be coated on a dehumidification rotor surface of each of the first to third areas 121, 122, and 123, and a dehumidifying agent such as silica gel, zeolite or the like may be used as the adsorption material.

A first blower 130 is provided at an outlet of the first area 121 to suction outdoor air into the outdoor air supply path 155 and the first area 121. A second blower 131 is provided at an outlet of the second area 122 to suction the outdoor air into the regeneration path 156 and the second area 122. Further, a third blower 130 is provided at an outlet of the humid channel 112 of the evaporative cooler 110 to flow the air which passes through the humid channel 112 to a first discharge path 153 or a second discharge path 154.

A heater 135 configured to heat the air flow to the second area 122 may be provided at an inlet of the second area 122. Various kinds of heaters such as a heater using electricity, a heater using hot water, and the like may be applied to the heater 135.

The flow path changer 140 allows path selection so that the air which passes through the humid channel 112 may flow to the first discharge path 153 or to the second discharge path 154. As an example, a three way valve may be used as the flow path changer 140. The air which flows through the first discharge path 153 is discharged to an outdoor space after passing through the third area 123 of the dehumidification rotor 120, and the air which passes through the second discharge path 154 is discharged to the outdoor space.

An indoor air introduction path 11 configured to supply air to an indoor space such as a room or a living room, the indoor space in which air conditioning occurs, and an indoor air discharge path 12 configured to discharge the air from the indoor space are each connected between the indoor space and the outdoor unit 100.

The indoor air introduction path 11 is connected to a first opening 101 formed in the outdoor unit 100, and the indoor air discharge path 12 is connected to a second opening 102.

The humid channel communication part 151, which is formed so that the air which passes through the dry channel 111 may flow to an inlet of the humid channel 112, and a condenser communication part 152, which is formed so that the air which passes through the dry channel may flow to the condenser 220, are formed at a location adjacent to an outlet of the dry channel 111.

The first damper 161 selectively opens or closes the first opening 101 or the condenser communication part 152, and the second damper 162 selectively opens or closes the second opening 102 or the humid channel communication part 151. That is, during a ventilation mode, the first damper 161 and the second damper 162 opens the first opening 101 and the second opening 102, respectively, and closes the condenser communication part 152 and the humid channel communication part 151, respectively. Further, during a cooling mode, the first damper 161 and the second damper 162 opens the condenser communication part 152 and the humid channel communication part 151, respectively, and closes the first opening 101 and the second opening 102, respectively.

Operations at the cooling mode and the ventilation mode in the above described air conditioner according to the present disclosure will be described.

The operation at the cooling mode will be described with reference to FIG. 1.

During the cooling mode, the heat pump of the indoor unit 200 is operated, and thus the air cooled by the evaporator 240 is supplied to the indoor space. In this case, the condenser 220 is heated due to a refrigerant of a high temperature and high pressure.

The first damper 161 and the second damper 162 are each in a state of closing the first opening 101 and a state of closing the second opening 102. In this state, the dehumidification rotor 120 rotates, and the first to third blowers 130, 131, and 132 are operated. Further, the water injection device provided in the humid channel 112 injects water to the humid channel 112.

The outdoor air is dehumidified by an operation of the first blower 130 while passing through the first area 121 of the dehumidification rotor 120 through the outdoor air supply path 155. The air which passes through the first area 121 is cooled by heat exchange with the humid channel 112 while passing through the dry channel 111 of the evaporative cooler 110. Some of the air which passes through the dry channel 111 flows to the condenser 220 through the condenser communication part 152, and cools the condenser 220 while passing through the condenser 220. The air which passes through the condenser 220 is discharged to the outdoor space. As described above, when the condenser 220 is cooled using the cooled air in the dry channel 111, the cooling performance may be improved, and since the refrigerant which flows in the condenser 220 is cooled, and overheating and overpressurizing of the refrigerant do not occur, operation stability of the heat pump may be improved, and frequent on/off operations of the compressor 210 may be prevented.

The remaining air which passes through the dry channel 111 is introduced into the humid channel 112 through the humid channel communication part 151 by an operation of the third blower 132. Since heat transmission occurs due to water evaporation in the humid channel 112, the air which passes through the dry channel 111 is cooled. In a case in which the air cooled by passing through the dry channel 111 flows to the humid channel 112, the temperature of the air which passes through the dry channel 111 may be easily decreased as compared to a case of using indoor air having a high temperature. Further, when the temperature of the air introduced into the humid channel 112 is high, since the number of revolutions of the third blower 132 should be increased to decrease the temperature of the air which passes through the dry channel 111 to a predetermined level, power consumption increases. On the other hand, when the air introduced into the humid channel 112 and then cooled by passing through the dry channel 111 is used like the present disclosure, since the temperature of the air which passes through the dry channel 111 may be decreased to a predetermined level without increasing the number of revolutions of the third blower 132, the power consumption for operation the third blower 132 may be reduced.

The air which passes through the humid channel 112 may be discharged from the flow path changer 140 to the outdoor space through the second discharge path 154.

Meanwhile, the outdoor air is introduced into the regeneration path 156 by an operation of the second blower 131, and the air introduced from outdoor may regenerate the dehumidification rotor 120 by removing the moisture adsorbed from the first area 121 while passing through the second area 122 of the dehumidification rotor 120 after being heated by the heater 135. The air which passes through the second area 122 is discharged to the outdoor space.

The operation at the ventilation mode will be described with reference to FIG. 2.

When the indoor air is ventilated, the first damper 161 and the second damper 162 opens the first opening 101 and the second opening 102, respectively, the condenser communication part 152 is blocked by the first damper 161, and the humid channel communication part 151 is blocked by the second damper 162.

In this state, the dehumidification rotor 120 rotates, and the first to third blowers 130, 131, and 132 are operated. In this case, the water injection device provided in the humid channel 112 does not inject water to the humid channel 112.

The outdoor air is supplied to the indoor space through the indoor air introduction path 11 after sequentially passing through the outdoor air supply path 155, the first area 121, the dry channel 111, and the first opening 101 due to the operation of the first blower 130.

The air in the indoor space is discharged to the outdoor space through the first discharge path 153 or the second discharge path 154 after sequentially passing through the indoor air discharge path 12, the second opening 102, and the humid channel 112.

In a case in which indoor air is warm and outdoor air is cold during the change of seasons, since the cold outdoor air is introduced into the indoor space, heat loss occurs. In this case, when the warm indoor air transfers heat to the dehumidification rotor 120 while passing the third area 123 of the dehumidification rotor 120 through the first discharge path 153, and the dehumidification rotor 120 rotates in order to be located at the first area 121, the heat is transferred to the air which passes through the first area 121 and thus heat efficiency may be improved.

In this case, the air discharged to the outdoor space is set to pass through the third area 123, but may also be set to perform total heat exchange with the air which passes through the first area 121 while passing through the second area 122 when the first discharge path 153 is connected to the regeneration path 156.

Since the third blower 132 suctions the air which passes through the humid channel 112, surface treatment having greater corrosion resistance may be formed on the third blower 132 to prevent corrosion generated by the moisture. On the other hand, since the second blower 131 flows only the outdoor air, corrosion resistant surface treatment is not formed. When the air which passes through the humid channel 112 is set to flow to the second area 122 for the total heat exchange between the air discharged to the outdoor space and the air which passes through the first area 121, corrosion resistance of the second blower 131 may be problematic. That is, when the humid channel 112 and the regeneration path 156 are connected and a mode in which the humid air in the humid channel 112 is discharged through the regeneration path 156 is operated, the second blower 131 without corrosion resistant surface treatment may be corroded by the humid air. In a case of the present disclosure, since the air which passes through the humid channel 112 is set to be discharged to the outside through the third area 123 using the third blower 132, durability of the second blower 131 may be prevented from degradation.

Meanwhile, when the total heat exchange is not necessary, the air which passes through the humid channel 112 is discharged to the outdoor space through the second discharge path 154.

As described above, upon merely rotating the first damper 161 and the second damper 162 during the cooling mode and the ventilation mode, a ventilation path may be simply configured in the outdoor unit 100.

According to the above-described configuration, the cooling performance may be improved during the cooling, the durability of the heat pump may be improved by preventing the repetitive on/off operations of the compressor 210 due to overheating of the condenser 220, the temperature of the air which passes through the dry channel 111 may be easily decreased by just a small wind volume, and the power consumption of the blower may be reduced.

According to the present disclosure, a condenser can be cooled using air which passes through a dry channel of an evaporative cooler to improve cooling performance, and durability of a heat pump can be improved by preventing repetitive on/off operations of a compressor due to overheating of the condenser.

Further, since the air cooled while passing through the dry channel of the evaporative cooler is supplied to the humid channel, the temperature of the air which passes through the dry channel can be decreased by a small wind volume, and power consumption of a blower can be reduced.

In addition, since the dry channel and the humid channel of the evaporative cooler can be used as a path through which indoor air and outdoor air flow during a ventilation mode, functions of the evaporative cooler can be expanded.

In addition, since total heat exchange occurs in a dehumidification rotor during the ventilation mode, the temperature of air introduced into an indoor space from an outdoor space using heat of the indoor air can be increased, and efficiency can be improved.

As described above, although the present disclosure is described in detail by preferable examples, the present disclosure is not limited to the above-described embodiments, changes may be made within the scope of each of the claims, detailed descriptions, and the accompanying drawings, and the above may be included in the present disclosure.

<Description of Reference Numerals>

| | |
|---|---|
| 11: indoor air introduction path | 12: indoor air discharge path |
| 100: outdoor unit | 101: first opening |
| 102: second opening | 110: evaporative cooler |
| 111: dry channel | 112: humid channel |
| 120: dehumidification rotor | 121: first area |
| 122: second area | 123: third area |
| 130: first blower | 131: second blower |
| 132: third blower | 140: flow path changer |
| 151: humid channel communication part | |
| 152: condenser communication part | |
| 153: first discharge path | 154: second discharge path |
| 155: outdoor air supply path | 156: regeneration path |
| 161: first damper | 162: second damper |
| 200: indoor unit | 210: compressor |
| 220: condenser | 230: expansion valve |

What is claimed is:

1. An air conditioner comprising:

an indoor unit including an evaporator of a heat pump configured to cool indoor air; and an outdoor unit including an evaporative cooler using evaporation latent heat of water generated in a humid channel to cool air which passes through a dry channel, a condenser of the heat pump cooled by air cooled while passing through the dry channel during a cooling mode, a condenser communication part provided so that some of the air which passed through the dry channel flows to the condenser, and a humid channel communication part provided so that the remaining air which passed through the dry channel flows to the humid channel.

2. The air conditioner of claim 1, wherein the outdoor unit includes a first opening configured to communicate with an indoor air introduction path configured to supply air to an indoor space, a first damper configured to open or close the first opening and the condenser communication part, a second opening configured to communicate with an indoor air discharge path configured to suction the air from the indoor space, and a second damper configured to open or close the second opening and the humid channel communication part.

3. The air conditioner of claim 2, wherein:

when indoor air is cooled in the evaporator of the indoor unit, the first damper closes the first opening so that some of the air which passes through the dry channel passes through the condenser to cool the condenser; and the second damper closes the second opening so that the remaining air which passes through the dry channel flows to the humid channel.

4. The air conditioner of claim 2, wherein:

during a ventilation mode, the first damper blocks the condenser communication part with opening the first opening, and air introduced from an outdoor space is supplied to the indoor space through the first opening after passing through the dry channel; and the second damper blocks the humid channel communication part with opening the second opening, and the indoor air is discharged to the outside after passing through the second opening and the humid channel.

5. The air conditioner of claim 1, wherein the outdoor unit includes a dehumidification rotor formed from a first area provided on an outdoor air supply path connected to the dry channel and through which the air introduced from an outdoor space passes, a second area provided on a regeneration path configured to communicate with the outdoor space, and a third area provided on a first discharge path provided between the first area and the second area and through which the air which passes through the humid channel is discharged to the outdoor space.

6. The air conditioner of claim 5, wherein:

a second discharge path through which the air which passes through the humid channel is discharged to the outdoor space is provided; and a path changer is provided so that the air which passes through the humid channel flows through one of the first discharge path and the second discharge path.

7. The air conditioner of claim 5, wherein:

a path is connected so that the air suctioned from the outdoor space is supplied to an indoor space after passing through the dry channel; and a path is connected so that the air discharged from the indoor space passes through the third area through the first discharge path after passing through the humid channel.

8. The air conditioner of claim 7, wherein, during a ventilation mode, indoor air transfers heat to the dehumidification rotor while passing the third area of the dehumidification rotor, and the dehumidification rotor rotates in order to be located at the first area, and the heat is transferred to the air which passes through the first area.

* * * * *